US007634860B2

(12) United States Patent
Hamel

(10) Patent No.: US 7,634,860 B2
(45) Date of Patent: Dec. 22, 2009

(54) STEAM BOX

(75) Inventor: Robert Hamel, Bowen Island (CA)

(73) Assignee: Transphase Technology, Ltd., Bowen Island, B.C. (CA)

( * ) Notice: Subject to any disclaimer, the term of this patent is extended or adjusted under 35 U.S.C. 154(b) by 0 days.

(21) Appl. No.: 11/122,131

(22) Filed: May 3, 2005

(65) Prior Publication Data

US 2005/0283995 A1 Dec. 29, 2005

Related U.S. Application Data

(60) Provisional application No. 60/566,931, filed on May 3, 2004.

(51) Int. Cl.
*F26B 11/02* (2006.01)

(52) U.S. Cl. ..... 34/117; 162/358.9

(58) Field of Classification Search ..... 34/444, 34/117, 122, 124, 125; 162/359.1, 358.9
See application file for complete search history.

(56) References Cited

U.S. PATENT DOCUMENTS 1,160,724 A * 11/1915 Landin ..... 34/629
2,030,625 A * 2/1936 Ellis ..... 162/161
2,369,450 A * 2/1945 Fisher et al. ..... 428/486
3,024,129 A * 3/1962 Brundige ..... 427/364
3,362,869 A * 1/1968 Welsh ..... 162/175
3,404,463 A * 10/1968 Kemp, Jr. ..... 34/446
3,432,936 A * 3/1969 Greenhalgh et al. ..... 34/306
3,750,306 A * 8/1973 Rodwin et al. ..... 34/69
3,853,604 A * 12/1974 Fleissner ..... 427/324
3,971,235 A * 7/1976 Frezza ..... 68/5 E
4,330,947 A * 5/1982 Throp ..... 34/568
4,351,700 A * 9/1982 Dove ..... 162/252
4,358,900 A * 11/1982 Dove ..... 34/568
4,398,355 A * 8/1983 Dove ..... 34/570
4,543,737 A * 10/1985 Boissevain ..... 34/92
4,573,402 A * 3/1986 Sharma et al. ..... 100/38
4,580,315 A * 4/1986 Beckwith ..... 16/308
4,580,355 A * 4/1986 Boissevain ..... 34/568
4,608,122 A * 8/1986 Klein et al. ..... 162/60
4,662,398 A * 5/1987 Wywailowski et al. ... 137/625.4

(Continued)

FOREIGN PATENT DOCUMENTS

EP 1310591 5/2003

(Continued)

*Primary Examiner*—Stephen M. Gravini
(74) *Attorney, Agent, or Firm*—Nixon Peabody LLP

(57) ABSTRACT

A steam box for applying steam to a moving web comprising a housing having a leading end and a trailing end positionable above and proximate to a moving web; a supply header within the housing, said supply header in communication with a steam source; at least first and second steam chambers aligned with said leading edge in the direction of movement of said web, said first and second steam chambers able to receive steam from the said supply header to apply steam through respective first and second steam discharge points to the moving web, and a screen plate securable to said housing, said screen plate including a horizontal plate; and a first descending barrier positioned between said first and second steam discharge points, said descending barrier having a first trailing side adjacent to said-second steam discharge point to protect said second steam discharge point from stock flung from the web.

20 Claims, 4 Drawing Sheets

U.S. PATENT DOCUMENTS 4,671,173 A * 6/1987 Boissevain ..... 100/38
4,685,389 A * 8/1987 Boissevain ..... 100/329
4,738,196 A * 4/1988 Boissevain ..... 100/328
4,765,067 A * 8/1988 Taylor ..... 34/465
4,786,529 A * 11/1988 Boissevain ..... 427/296
4,836,894 A * 6/1989 Chance et al. ..... 162/253
4,867,054 A * 9/1989 Taylor ..... 100/331
4,915,788 A * 4/1990 Winheim ..... 162/207
5,077,913 A * 1/1992 Akerblom et al. ..... 34/85
5,090,133 A 2/1992 Taylor
5,106,655 A 4/1992 Boissevain et al.
5,416,980 A * 5/1995 Ilvespaa ..... 34/117
5,439,559 A * 8/1995 Crouse ..... 162/358.5
5,477,824 A * 12/1995 Reedy ..... 123/322
5,519,935 A * 5/1996 Lawruk et al. ..... 29/748
5,519,945 A * 5/1996 Ahvenniemi et al. ..... 34/122
5,611,396 A * 3/1997 Reed ..... 165/300
5,672,249 A * 9/1997 Vinson et al. ..... 162/111
5,689,897 A * 11/1997 Schiel ..... 34/114
5,711,087 A * 1/1998 Pazdera ..... 34/114
5,752,324 A * 5/1998 Muller et al. ..... 34/114
5,789,031 A * 8/1998 Hirabayashi et al. ..... 427/341
5,933,981 A * 8/1999 Meschenmoser ..... 34/456
5,983,787 A * 11/1999 Linsuri et al. ..... 100/38
5,993,980 A * 11/1999 Schmitz et al. ..... 428/633
6,006,443 A * 12/1999 Karvinen ..... 34/446
6,107,014 A * 8/2000 Dagan et al. ..... 430/496
6,119,362 A * 9/2000 Sundqvist ..... 34/120
6,171,653 B1 * 1/2001 Kohl et al. ..... 427/377
6,187,137 B1 * 2/2001 Druecke et al. ..... 162/109
6,228,216 B1 * 5/2001 Lindsay et al. ..... 162/111
6,264,795 B1 * 7/2001 Hamel ..... 162/207
6,274,001 B1 * 8/2001 Mohan ..... 162/206
6,280,573 B1 * 8/2001 Lindsay et al. ..... 162/198
6,309,704 B1 * 10/2001 Hess et al. ..... 427/315
6,318,727 B1 * 11/2001 Hada ..... 277/345
6,364,997 B1 * 4/2002 Dagan et al. ..... 162/9
6,391,532 B1 * 5/2002 Sunderrajan et al. ..... 430/533
6,408,534 B1 * 6/2002 Alen et al. ..... 34/114
6,432,267 B1 * 8/2002 Watson ..... 162/111
6,432,272 B1 * 8/2002 Hollenberg et al. ..... 162/204
6,444,030 B1 * 9/2002 Kohl et al. ..... 118/63
6,449,874 B2 * 9/2002 Pellinen ..... 34/452
6,804,726 B1 * 10/2004 Ellenby et al. ..... 710/8
7,459,061 B2 * 12/2008 Passiniemi ..... 162/272
7,513,975 B2 * 4/2009 Burma ..... 162/263
2003/0191285 A1 * 10/2003 Miwa et al. ..... 530/350
2007/0256806 A1 * 11/2007 Scherb et al. ..... 162/358.4

FOREIGN PATENT DOCUMENTS

WO WO 9941450 8/1999

* cited by examiner

STEAM BOX

This application claims the benefit of U.S. Provisional Application No. 60/566,931, filed May 3, 2004.

FIELD OF THE INVENTION

This invention relates to an apparatus and method for delivering steam to a web of paper and more particularly for methods and devices for delivering steam during the paper making process.

BACKGROUND OF THE INVENTION

Paper-making machines include press sections positioned before the paper-making machine's dryer section. In the press section, the paper web is drained of moisture (also referred to as dewatering). The drainage rate of the paper web is proportional to the viscosity and surface tension of the trapped water. Increasing the web temperature decreases the water viscosity and surface tension and improves the pressing process. Also increasing the dewatering rate at the press section of the paper-making machine decreases the moisture content of the web before the web enters the dryer section, thereby reducing the energy or time needed to further dewater the web in the dryer section. Therefore, it is common to apply steam to a paper web prior to the sheet entering the press section using the steam to heat the web.

Steam is applied to the web at spaced increments across the paper-making machine. At the dry end of the machine (following the dryer section), the web is passed through a calendar stack. The surface finish and thickness (or caliper) of the web is affected by the moisture and temperature profiles of the web. Therefore the application of steam to the web will influence both the moisture and temperature of the sheet, and at the dry end of the machine, the caliper and surface finish qualities of the web.

The press section of a paper-making machine typically raises the solidity of the web by 20% to 50%. The steam is typically provided by a steam box mounted adjacent to the press roll either before or in the press section to condense steam onto the surface of the web. The design of the steam box is critical to the efficiency of steam usage; the steam box's ability to profile the moisture profile across the web; and the steam box's ability to stay clean. If the steam box cannot remain clean the blockage will reduce its ability to provide sufficient steam to influence the web temperature to provide greater dewatering, and its ability to apply different levels of steam across the web to permit the press to level the moisture profile of the web.

Related art includes U.S. Pat. No. 6,264,795 to Hamel; U.S. Pat. No. 6,408,534 to Alen et al.; and U.S. Pat. No. 5,711,087 to Pazdera.

One disadvantage of prior art steam boxes are that as they are installed in the press section against a roll face they are subject to stock being flung from the roll surface onto the steam box face (i.e. diffuser or screen plate) due to centrifugal forces. Once the face of the steam box is blinded by stock, this blockage may substantially degrade the steam box's ability to deliver steam.

SUMMARY OF THE INVENTION

An apparatus and method that addresses the foregoing problems is provided in the present invention. The approach taken by this apparatus and method allows steam to contact the web without exposing the steam discharge points to plugging from stock flung off the web roll by centrifugal forces.

To carry out this novel approach the present invention provides for a steam box for applying steam to a moving web comprising: a housing having a leading and trailing edge positionable adjacent to the moving web; a main supply header within the housing in communication with the steam source; at least one steam chamber proximate to the leading edge of the housing to receive steam from the main supply header and to apply steam to the moving web, the applied steam increasing the moisture content of the web and raising the web temperature, thereby changing the viscosity of water in the moving web and insuring increased dewatering of the moving web in the press nips. On the leading side of each steam chamber is a descending barrier (either from the leading edge of the housing or a screen plate) to protect the steam chamber from flung stock. There may be more than one steam chambers positioned perpendicular to the direction of movement of the web or aligned with the direction of movement of the web (typically spaced in an array). Such number of steam chambers and discharge points depend on the size and speed of the paper machines and web, and the volume of steam needed.

The screen plate is mounted in a fixed or removable fashion to the main housing. The screen plate protects the steam discharge points from stock flung off of the web due to centrifugal forces. The screen plate includes two components, a horizontal plate having one or more steam discharge points and a descending barrier that protects the steam discharge points from flung stock. The screen plate can have more than one steam discharge point depending on paper machine speed and size. The descending barrier forces the steam discharged from the steam chamber into a pressure wedge to insure maximum steam absorption by the moving web. The screen plate can be cleaned using means known in the art such as by using cleanout ports that can be internally reached inside the main housing of the steam box; or by removing the screen plate and associated zone box/diffuser in its entirety.

The steam box may be segmented into zones in the direction perpendicular to movement of the web in order to adjust the steam flow to change the moisture profile in the cross direction. The cleanout ports can be reached by removal of the actuator assemblies, which are mounted in each zone.

A further embodiment of a steam box is provided, comprising, A steam box for applying steam to a moving web comprising a housing having a leading end and a trailing end positionable above and proximate to a moving web; a supply header within the housing, said supply header in communication with a steam source; at least first and second steam chambers aligned with said leading edge in the direction of movement of said web, said first and second steam chambers able to receive steam from the said supply header to apply steam through respective first and second steam discharge points to the moving web; and a first screen plate securable to said housing, said screen plate including a horizontal plate; and a first descending barrier positioned between said first and second steam discharge points, said descending barrier having a first trailing side adjacent to said second steam discharge point to protect said second steam discharge point from stock flung from the web.

The screen plate may further include a second descending barrier positioned between said second steam discharge point and said trailing end and the first steam discharge point may be positioned proximate to a trailing edge of said leading end. Also the first descending barrier may include a first lower side secured to said horizontal plate proximate said first steam discharge point, the first lower side may be connected to said first trailing side. The first lower side may descend from said horizontal plate at an angle between 5° and 20° degrees.

The second descending barrier may have a second lower side secured to said horizontal plate proximate said second steam discharge point, the second lower side connected to said second trailing side. The second lower side descends from said horizontal plate at an angle between 5° and 20°.

DETAILED DESCRIPTION OF THE INVENTION

Figure 1:
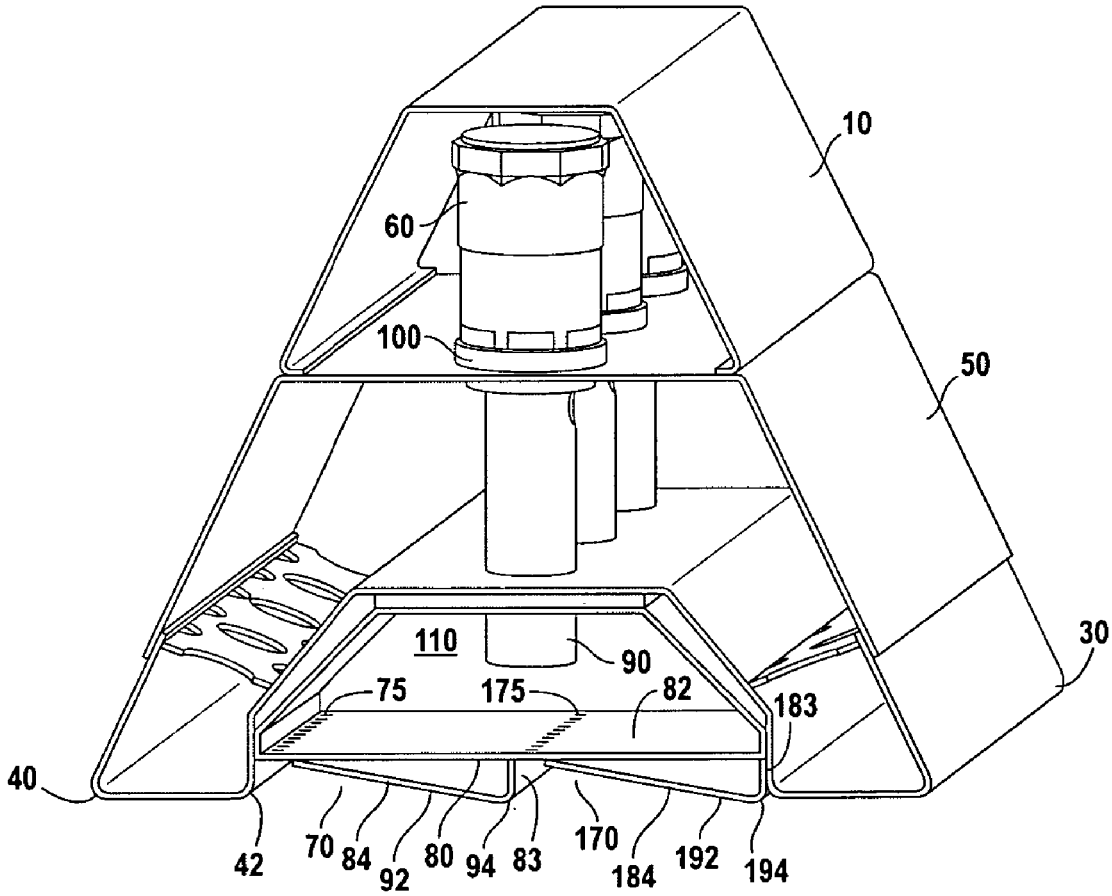
FIG. 1 is a cross sectional perspective view of a steam box according to the invention.
Figure 2:
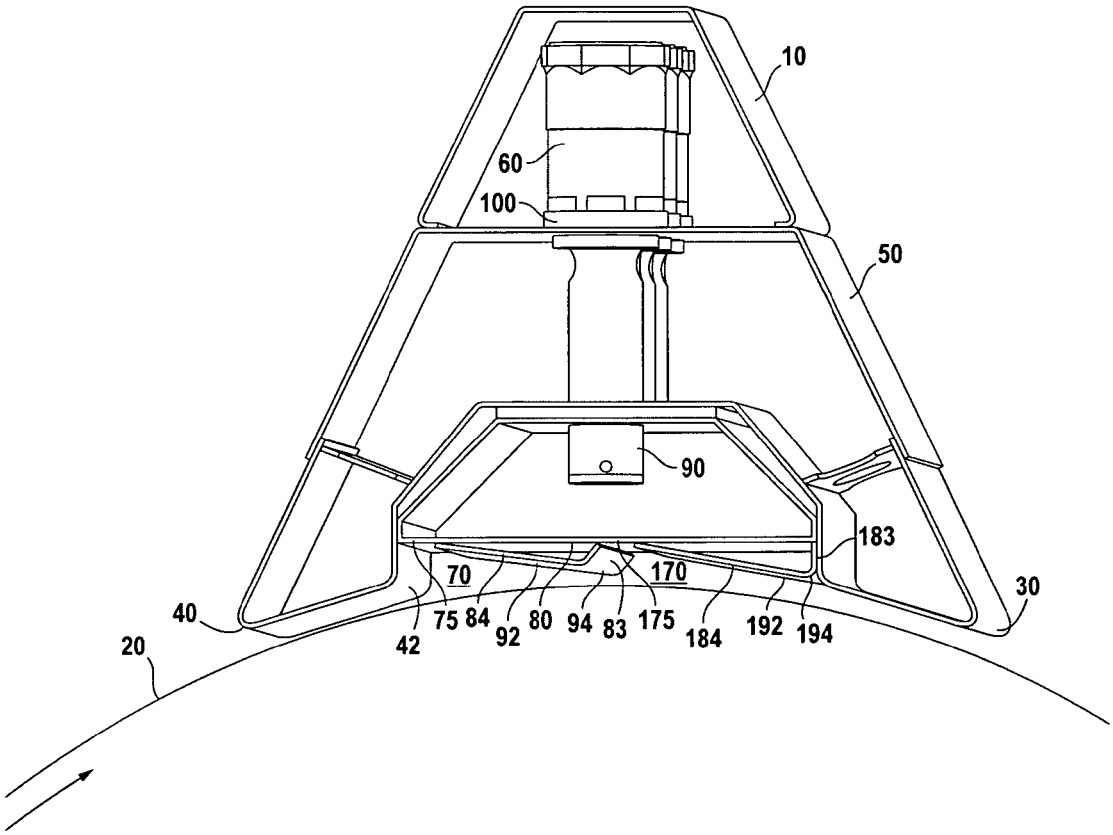
FIG. 2 is a side cross sectional perspective view thereof.
Figure 3:
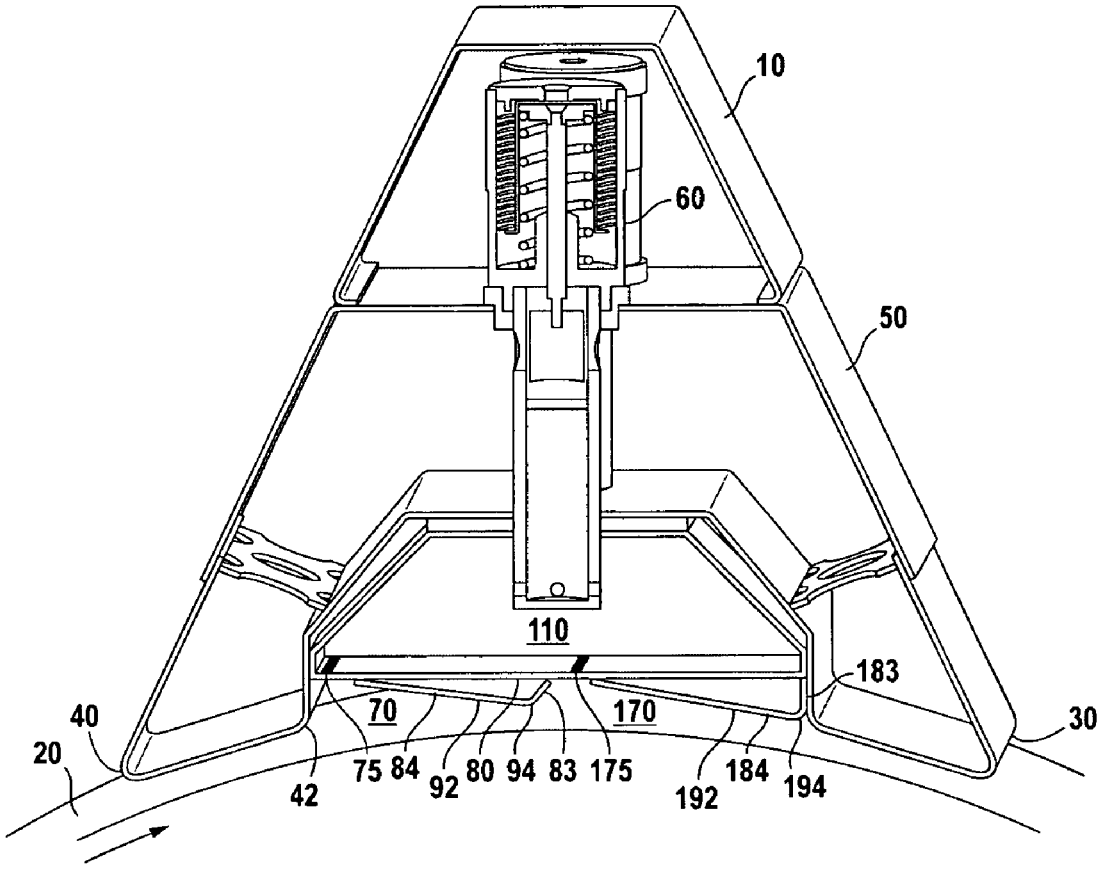
FIG. 3 is a further side cross sectional side view thereof.
Figure 4:
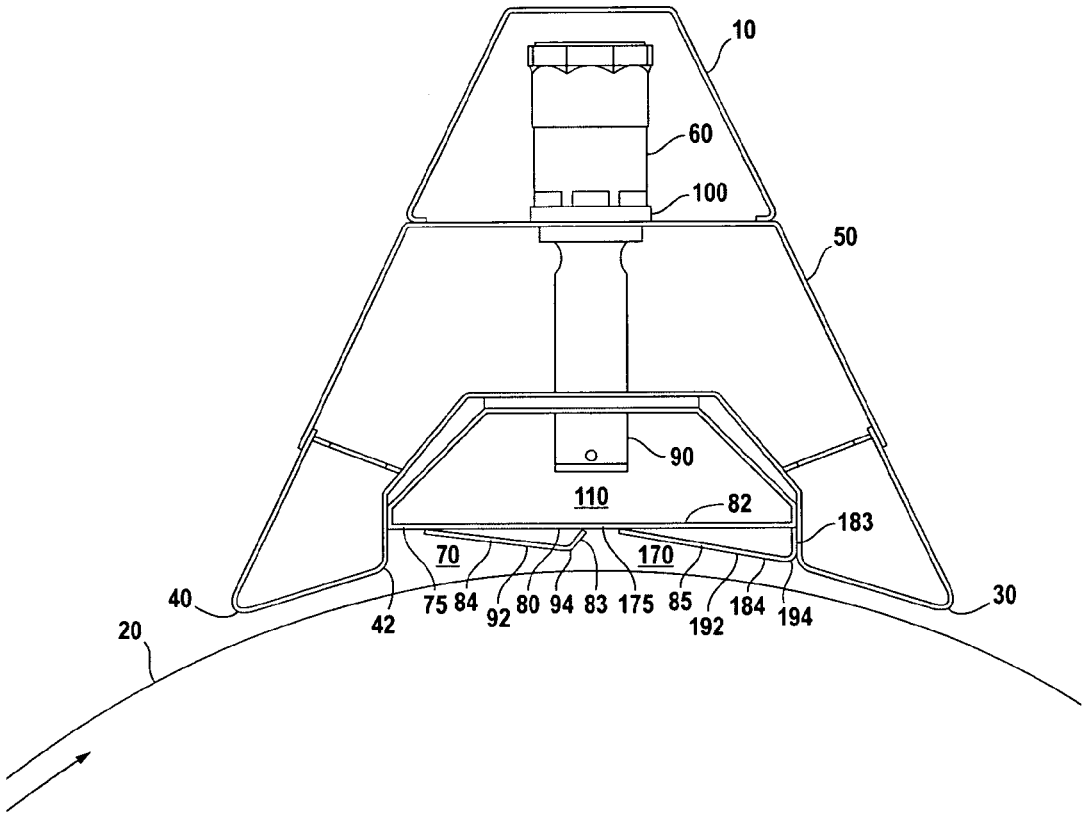
FIG. 4 is another side cross-sectional view thereof.

As seen in FIGS. 1 through 4, steam box 10 is, in use, positioned in close proximity to roll 20. Roll 20 holds a paper web and rotates rapidly in a clockwise direction, moving the paper web from leading end 40 of steam box 10 to trailing end 30. As roll 20 rotates stock is flung from roll 20 onto steam box 10 in a generally clockwise direction. In this document "leading" refers to the direction of the steam box opposite the direction of rotation (left in the drawings), and "trailing" refers to the direction of the steam box in the direction of rotation (right in the drawings).

Steam box 10 includes housing 50 and supply header 60 within housing 50. Housing 50 is in communication with a steam source (not shown) through supply header 60 that allows steam to be transferred to steam box 10.

At least a first steam chamber 70 is positioned proximate to the leading end 40 of housing 50 to receive steam from supply header 60 and allow it to be applied to the moving web on roll 20. As seen in the figures a second steam chamber 170 may be present. The steam will increase the moisture content of the web and raise the web temperature to change the viscosity of the water in the moving web and provide for increased dewatering of the moving web in the press nips.

There may be more than two steam chambers 70, 170 aligned both perpendicular to the movement of roll 20 and/or aligned in the direction of movement of roll 20. As steam box 10 is applied to larger rolls and faster paper machines, the volume of steam that must be delivered to the moving web dictates the number of steam chambers 70, 170 and steam discharge points 75, 175 necessary.

Screen plate 80 is mounted to main housing 10. Screen plate 80 includes two components, horizontal plate 82 having one or more steam discharge points 75, 175, and descending barriers 84, 184 to protect steam discharge points 75, 175 from flung stock. Descending barriers 84, 184 are thereby shaped such that trailing sides 83, 183 protect trailing steam discharge points 75, 175 from stock flung off of roll 20 due to centrifugal forces. Horizontal plate 82 may have more than two steam discharge points 75, 175. Steam discharge points 75, 175 (which may be holes, apertures or slots and the like in plate 82 and may be covered by a porous media) are protected from flung stock by either the trailing end 42 of leading end 40 (for example if the steam discharge points 75 is the closest to the leading end 40) or the trailing end 83 of descending barrier 84 (as illustrated with steam discharge point 175 in the Figures). Preferably descending barriers 84, 184 gradually descend from steam discharge points 75, 175 towards trailing edge 30. Descending barriers 84, 184 as depicted in the Figures, have a straight lower side 92, 192 descending towards trailing end 30, although a curved edge would also be effective. Likewise trailing sides 83, 183 of descending barriers 84, 184 are depicted as straight, although a curved surface would also be effective.

Descending barriers 84, 184 force the steam discharged into steam chambers 70, 170 into a pressure wedge as the pressure pushes the steam below the descending barriers 84, 184 of plate 82. The steam is thus pushed downward into roll 20 thereby providing improved contact with the paper sheet and further steam absorption by the moving web.

Descending barrier 184, as seen in the figures descends after steam discharge point 175, and lower side 192 of descending barrier 184 descends gradually at an angle of approximately 5° to 20° from horizontal plate 82 towards the trailing end of the steam box 10. When lower side 192 reaches point 194, trailing side 183 ascends at an angle of 70° to 85° to lower side 192. Preferably trailing side meets horizontal plate 82 at an approximate 90° angle at a position close to the trailing steam discharge point 175. Such a shape is preferable due to the shape of the leading side of trailing edge 30.

Descending barrier 84 is shaped similarly to descending barrier 184, but as its trailing side 96 does not need to align to trailing end 30, it preferably angles upwardly from point 94 at an angle of about 100° to 120° from lower side 92.

Descending barriers 84, 184 may include perforations to allow them to fill with steam, which helps reduce the condensation on barriers 84, 184. Alternatively, descending barriers 84, 184 may be hollow or may be solid.

Screen plate 80 can be cleaned if necessary from cleanout ports 90 inside main housing 50 of steam box 10. Clean out ports 90 may be reached by removal of the external port cover 100. Alternatively, screen plate 80 can be cleaned and accessed by removing the assembly.

Steam box 10 may be segmented into zones by vertical plates 110 perpendicular to the direction of rotation of roll 20. These zones allow the steam flow to be adjusted to influence the web water viscosity in the press direction thereby allowing the press nips to adjust the moisture profile in the cross direction. The cleanout ports 90 can be reached by removal of the actuator assemblies, which are mounted in each zone.

Although the particular preferred embodiments of the invention have been disclosed in detail for illustrative purposes, it will be recognized that variations or modifications of the disclosed apparatus lie within the scope of the present invention.

I claim:

1. A steam box, comprising:

a housing having a leading end and a trailing end positionable above and proximate to a moving web, said moving web flinging stock towards said housing;

a supply header within the housing, said supply header in communication with a steam source;

at least first and second steam chambers aligned in a direction of rotation of said web and positioned external to the housing, said first and second steam chambers positioned between said leading end and said trailing end, said first and second steam chambers able to receive steam from said supply header to apply steam through respective first and second steam discharge points to the moving web; and a screen plate securable to said housing, said screen plate including a horizontal plate with respect to the moving web and a first barrier vertically descending towards said web a first distance along the direction of rotation, the first barrier positioned between said first and second steam discharge points along the direction of rotation and extending below said first and second steam discharge points to form said first steam chamber therebetween, said descending barrier having a first trailing side positioned adjacent to said second steam discharge point proximal to the leading end and vertically extending upward from the first distance toward the horizontal plate to protect said second steam discharge point from said stock flung from the web while said web is moving.

2. The steam box of claim 1 wherein said screen plate further includes a second barrier descending towards said web positioned between said second steam discharge point and said trailing end and extending below said second steam discharge point.

3. The steam box of claim 2 wherein first steam discharge point is positioned proximate to a trailing edge of said leading end.

4. The steam box of claim 3 wherein said first descending barrier includes a first lower side secured to said horizontal plate proximate said first steam discharge point.

5. The steam box of claim 4 wherein said first lower side is connected to said first trailing side.

6. The steam box of claim 5 wherein said second descending barrier includes a second lower side secured to said horizontal plate proximate said second steam discharge point.

7. The steam box of claim 6 wherein said second lower side is connected to said second trailing side.

8. The steam box of claim 7 wherein said first lower side descends from said horizontal plate at an angle between and including 5 and 90 degrees.

9. The steam box of claim 8 wherein said second lower side descends from said horizontal plate at an angle between and including 5 and 90 degrees.

10. The steam box of claim 9 further comprising a third and a fourth steam chamber, said third and fourth steam chambers aligned with said first and second steam chambers, respectively, perpendicular to the direction of movement of the web.

11. The steam box of claim 7, wherein said first and second descending barriers are perforated to allow passage of steam therethrough.

12. The steam box of claim 7, wherein said first and second descending barriers are hollow.

13. The steam box of claim 7, wherein said first and second descending barriers are solid.

14. The steam box of claim 4 wherein said first lower side descends gradually from said horizontal plate to said first trailing side.

15. The steam box of claim 6 wherein said second lower side descends gradually from said horizontal plate to said second trailing side.

16. The steam box of claim 2 wherein said first steam discharge point comprises a plurality of apertures in said horizontal plate.

17. The steam box of claim 16 wherein said second steam discharge point comprises a plurality of apertures.

18. The steam box of claim 10 wherein each of said first and second steam discharge points comprise a plurality of apertures, and said apertures are covered by a porous media.

19. A steam box, comprising:

a housing having a leading end and a trailing end oriented along a direction of rotation of a moving web, the housing positioned a set distance apart an outer surface of the moving web, said moving web flinging stock towards said housing;

a supply header within the housing, said supply header in communication with a steam source;

a screen plate securable to said housing, said screen plate including a horizontal plate, the screen plate including a first steam discharge point at a first distance from the leading end along the direction of rotation and a second steam discharge point at a second distance from the leading end along the direction of rotation, wherein the second distance is greater than the first distance;

a first barrier coupled to the screen plate and horizontally positioned between the first and second steam discharge points, said first barrier located between the screen plate and the moving web and configured to gradually descend towards said moving web along a distance between the first and second discharge points, said first barrier having a first trailing side positioned between the first and second distances and configured to prevent stock flung from the moving web from contacting the first steam discharge point; and a first steam chamber defined as a first area external to the housing and located between the outer surface of the moving web and the first barrier, said first steam chamber capable of receiving steam at least from the first steam discharge point to apply steam to the moving web.

20. The steam box of claim 19 further comprising:

a second barrier coupled to the screen plate and horizontally positioned between the second steam discharge point and the trailing end, said second barrier located between the screen plate and the moving web and configured to gradually descend towards said moving web between the second discharge point and the trailing end; and a second steam chamber defined as a second area external to the housing and located between the outer surface of the moving web and the second barrier, said second steam chamber capable of receiving steam at least from the second steam discharge point to apply steam to the moving web.

* * * * *